US006184451B1

(12) United States Patent
Miller et al.

(10) Patent No.: US 6,184,451 B1
(45) Date of Patent: Feb. 6, 2001

(54) LASER CUTTING OF HAND DRUMHEAD

(75) Inventors: Robert O. Miller, W. Babylon; James D'Addario, Old Westbury, both of NY (US)

(73) Assignee: J. D'Addario & Company, Inc., Farmingdale, NY (US)

( * ) Notice: Under 35 U.S.C. 154(b), the term of this patent shall be extended for 0 days.

(21) Appl. No.: 09/506,146

(22) Filed: Feb. 17, 2000

(51) Int. Cl.[7] ..... G10D 13/02
(52) U.S. Cl. ..... 84/411 R; 84/414
(58) Field of Search ..... 84/411 R, 414; 219/121.69, 121.72

(56) References Cited

U.S. PATENT DOCUMENTS 2,850,156 * 9/1958 Shane ..... 206/575
5,385,076 * 1/1995 Belli ..... 84/474
5,419,430 * 5/1995 Wilson et al. ..... 206/216

* cited by examiner

*Primary Examiner*—Robert E. Nappi
*Assistant Examiner*—Shih-yung Hsieh
(74) *Attorney, Agent, or Firm*—Alix, Yale & Ristas, LLP

(57) ABSTRACT

A two ply, synthetic drumhead for use in hand drums is created by using a laser to precisely remove excess material in the form of V-shaped notches from the peripheral portion of each layer disc of drumhead material prior to bonding and forming the drumhead sheet. After removal of the excess material, each layer disc has a peripheral edge consisting of equal size finger-like projections alternating with V-shaped notches. The layers are positioned so that the notches of one layer are covered by the projections of the other layer, producing a finished drumhead having a uniform exterior appearance and feel. The drumhead is tuned to duplicate the sound of a natural skin drumhead by positioning a damping element between the layer discs prior to bonding and assembly.

20 Claims, 6 Drawing Sheets

LASER CUTTING OF HAND DRUMHEAD

BACKGROUND OF THE INVENTION

This invention relates generally to the field of musical drums and is more particularly directed to a drumhead and a method for producing the drumhead. The drumhead is specifically adapted to be used in conjunction with hand drums.

Hand drums refer to musical drums that are usually played with the hand instead of with sticks, e.g., conga, bongo, djembe and bata drums. Hand drums have a generally cylindrical drum shell, typically constructed of wood, which has an open top and bottom. Shells for hand drums, such as conga drums, frequently have a shape which is larger around the middle and tapered toward the top and bottom openings. The top opening is usually covered with an animal skin drunhead tightened and tuned to a desired musical tone. Traditionally, such animal skins were tightened over the top of the wooden drum shell by the use of rawhide binding strips, twine or rope, producing a drum and head assembly not easily tuned or modified. While natural skin drumheads produce beautiful musical tones, they are also very sensitive to atmospheric changes such as heat and humidity. Large changes in temperature or humidity can dramatically change the musical tone of a natural skin head and render drums so equipped unplayable.

To address these disadvantages, musical instrument makers have developed synthetic drumheads closely approximating the musical characteristics of traditional skin drumheads. Synthetic drumheads are constructed from sheets of synthetic material joined to a drum hoop and formed to fit over the open top of a drum shell. The drum hoop is sized to pass over the open top end of a drum shell and be drawn toward the bottom of the drum shell by a counterhoop and tensioning mechanisms. Using such an arrangement makes changing drumheads and tuning of hand drums relatively quick and easy.

Manufacturing a synthetic drumhead which duplicates the sound quality of a natural skin drumhead requires the use of relatively thick layers of synthetic material. To construct a hand drumhead, these flat sheets of synthetic material must be formed into a shape having a planar central portion surrounded by a conical portion which terminates in a circular edge. Skin drumheads assume this configuration naturally when stretched over the open end of a drum shell. In contrast, when a flat disc of synthetic material is formed into a drumhead having a conical peripheral portion, a significant amount of excess material is produced which will overlap in folds creating a rough and irregular exterior surface on the conical portion of the drumhead.

It is known in the art to cut the peripheral edge portion of a synthetic drumhead into a series of slots which will allow the excess material to overlap without folding, somewhat alleviating the irregular surface problem. However, the overlapping material produces an uneven surface and the slots cut in the peripheral edge of the drumhead must be covered to produce a professional appearing drumhead.

SUMMARY OF THE INVENTION

The present invention is directed to a unique method for producing a synthetic hand drumhead by removing excess material from the periphery of the drumhead in the form of precisely cut V-shaped notches, leaving a peripheral edge made up of a series of finger-like projections of equal size. The removed material allows the synthetic drumhead material to lay flat without overlapping when it is formed into the shape of a drumhead. The notches are preferably cut with a numerically controlled laser, which can simultaneously cut a plurality of sheets of drumhead material.

During the forming process for the preferred embodiment of the drumhead, identically cut discs of drumhead material are bonded to each other with the finger-like projections of the first layer covering the V-shaped notches of the second layer. This configuration of layers produces a conical peripheral portion of a drumhead having a uniform appearance and feel which appeals to hand drum players.

In a preferred embodiment, the drumhead may be tuned by adding a damping element between the discs of drumhead material prior to forming, resulting in a drumhead which more closely duplicates the sound of a natural skin head. In a further preferred embodiment, the outwardly facing or planar surface of the drumhead is texturized to give the normally smooth synthetic material a more natural appearing and feeling surface texture.

An object of the present invention is to provide a method for cutting the disk-shaped layers of a hand drumhead from sheets of synthetic material which allows the efficient production of professional quality synthetic hand drumheads.

Another object of the invention is to provide a synthetic hand drumhead having a uniform outwardly facing surface and professional appearance.

A further object of the invention is to provide a method for manufacturing a synthetic hand drumhead of superior appearance and musical quality.

A yet further object of the invention is to provide a new and improved synthetic hand drumhead which closely approximates the feel and sound quality of a natural skin hand drumhead.

These and other objects, features and advantages of the invention will become readily apparent to those skilled in the art upon reading the description of the preferred embodiments, in conjunction with the accompanying drawings.

BRIEF DESCRIPTION OF THE DRAWINGS

Other objects and advantages of the invention will be evident to one of ordinary skill in the art from the following detailed description, made with reference to the accompanying drawings, in which.

DETAILED DESCRIPTION OF THE PREFERRED EMBODIMENT

Figure 1:
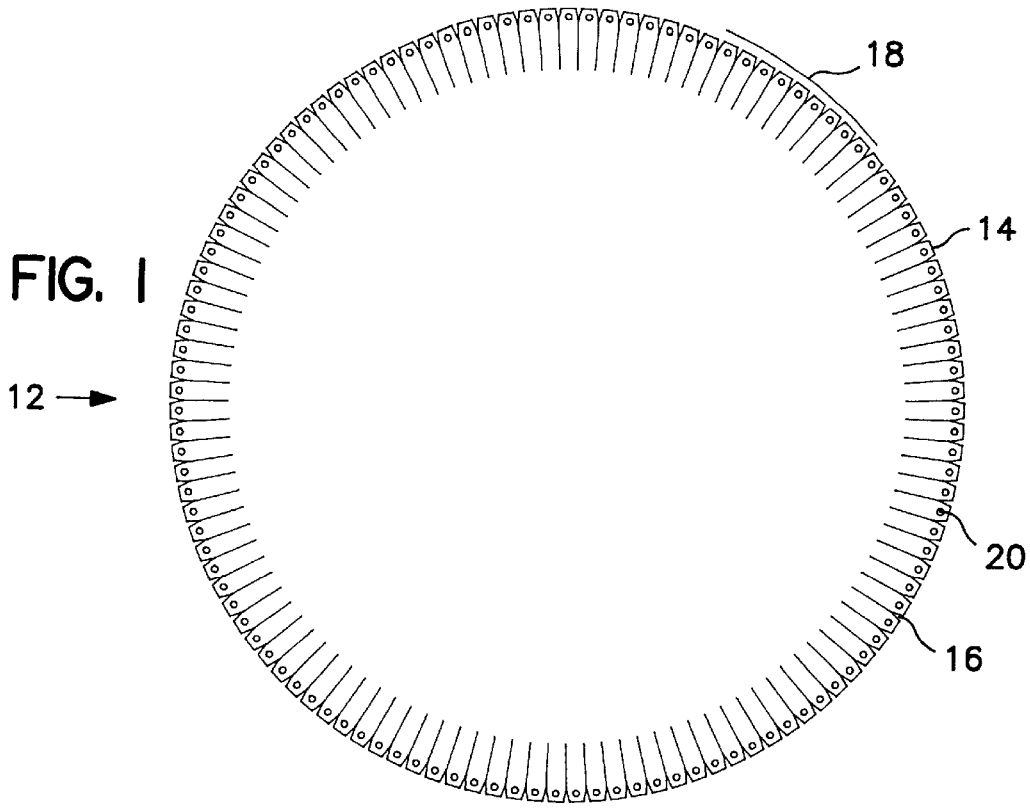
FIG. 1 is a top plan view of a disc of drumhead material prepared according to one aspect of the claimed invention.
Figure 1A:
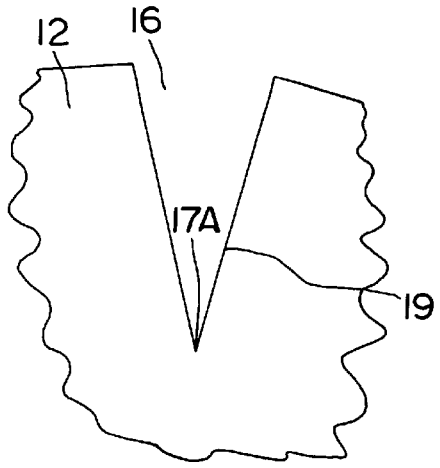
FIGS. 1A, 1B and 1C are enlarged views of the disc of FIG. 1, illustrating various possible configurations.
Figure 1B:
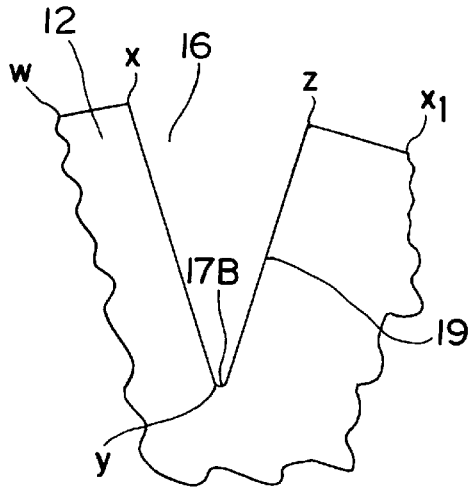
Figure 1C:
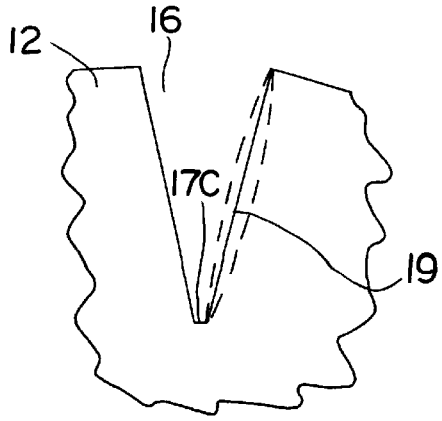

Referring now to the drawings in more detail and initially to FIG. 1, a disc of drumhead material 12 is shown having a peripheral edge 18 cut into a series of V-shaped notches 16, leaving equal sized finger-like projections 14. In the context of this application, the term Vshaped is used to describe the general shape of the material removed from the peripheral edge 18 of the drumhead layer discs. Notches having a pointed apex 17A, a rounded apex 17B or a square apex 17C are illustrated in FIGS. 1A, 1B and 1C, respectively. The angled sides 19 of the notches 16, 16A are preferably straight, but may be curved as indicated by the dashed lines in FIG. 1C. V-shaped notches 16, 16A may take any of the forms illustrated in FIGS. 1A, 1B or 1C without departing from the spirit and scope of the invention.

Figure 2:
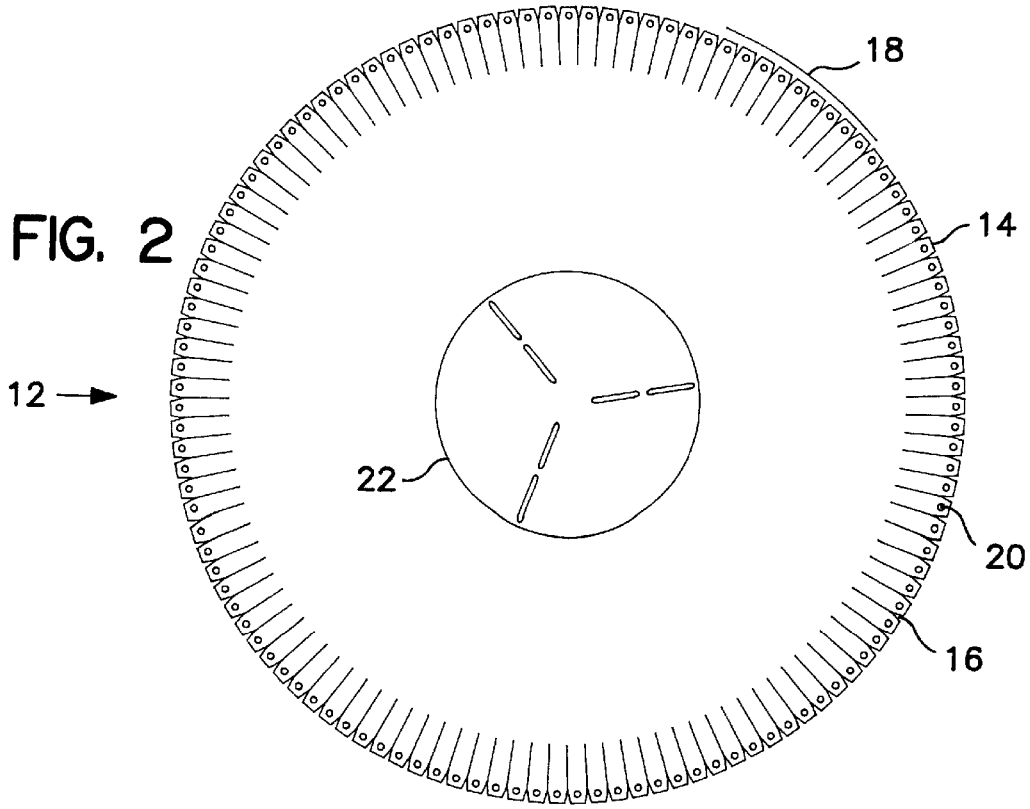
FIG. 2 is a top plan view of the disc of FIG. 1 with a damping element centrally positioned thereon.

FIG. 2 illustrates another disc of drumhead material 12 with a damping element centrally positioned on the disc. The discs 12 of FIGS. 1 and 2 are preferably cut from flat sheets of drumhead material by a programmable machine tool using a laser cutting head. The use of an automated tool (not illustrated) and a laser cutting instrument result in discs of uniformly identical size having exactly the desired amount and shape of material removed from their peripheral edge.

Figure 3:
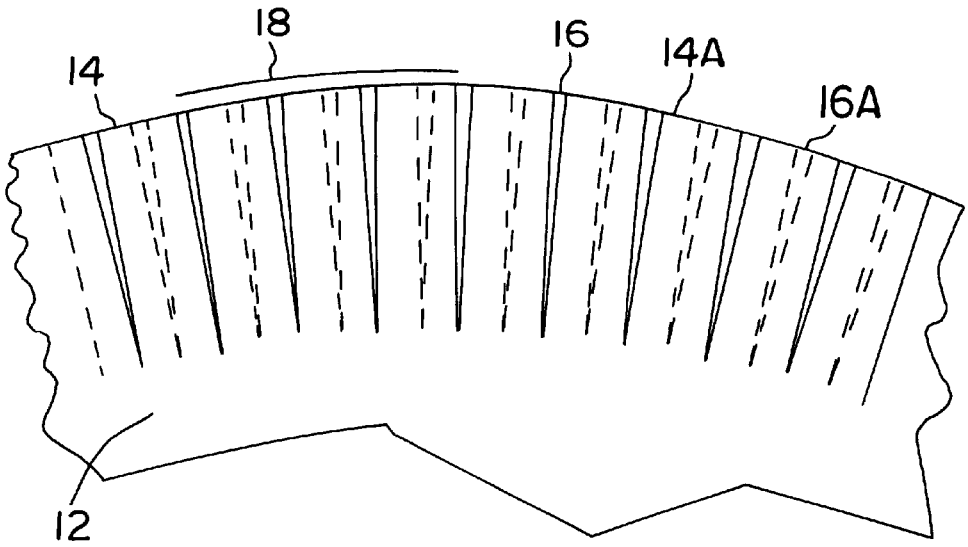
FIG. 3 is a schematic view, partly in phantom, of two discs of FIG. 1 (partially illustrated) positioned according to an aspect of the present invention.

FIG. 3 illustrates the positioning of two discs 12 (partially illustrated) prior to forming and bonding. The finger-like projections 14 of the top disc cover the V-shaped notches 16A of the bottom disc and the finger-like projections 14A of the bottom disc are beneath the V-shaped notches 16 of the top disc.

Figure 4:
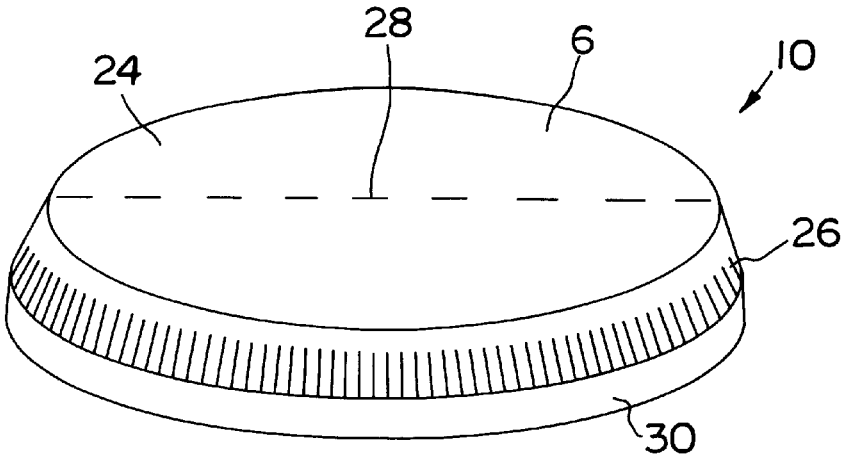
FIG. 4 is a perspective view of a drumhead in accordance with the present invention.

FIG. 4 illustrates a finished drumhead 10 according to the present invention. The layered flat discs of FIG. 3 are bonded together over a form having a substantially planar central portion 28 surrounded by a conical connecting surface 26 which connects the planar central portion 28 of the drumhead 10 with the drum hoop 30. The conical connecting portion 26 terminates in a circular edge which is secured within the drum hoop 30 by use of a resin or epoxy 33. In a preferred embodiment, each finger-like projection has a hole 20 cut near the peripheral edge. These holes 20 allow the resin or epoxy 33 to pass through before hardening, producing a stronger bond between the drum hoop 30 and the finger-like projections 14 which make up the connecting surface 26 of the drumhead 10.

Figure 5:
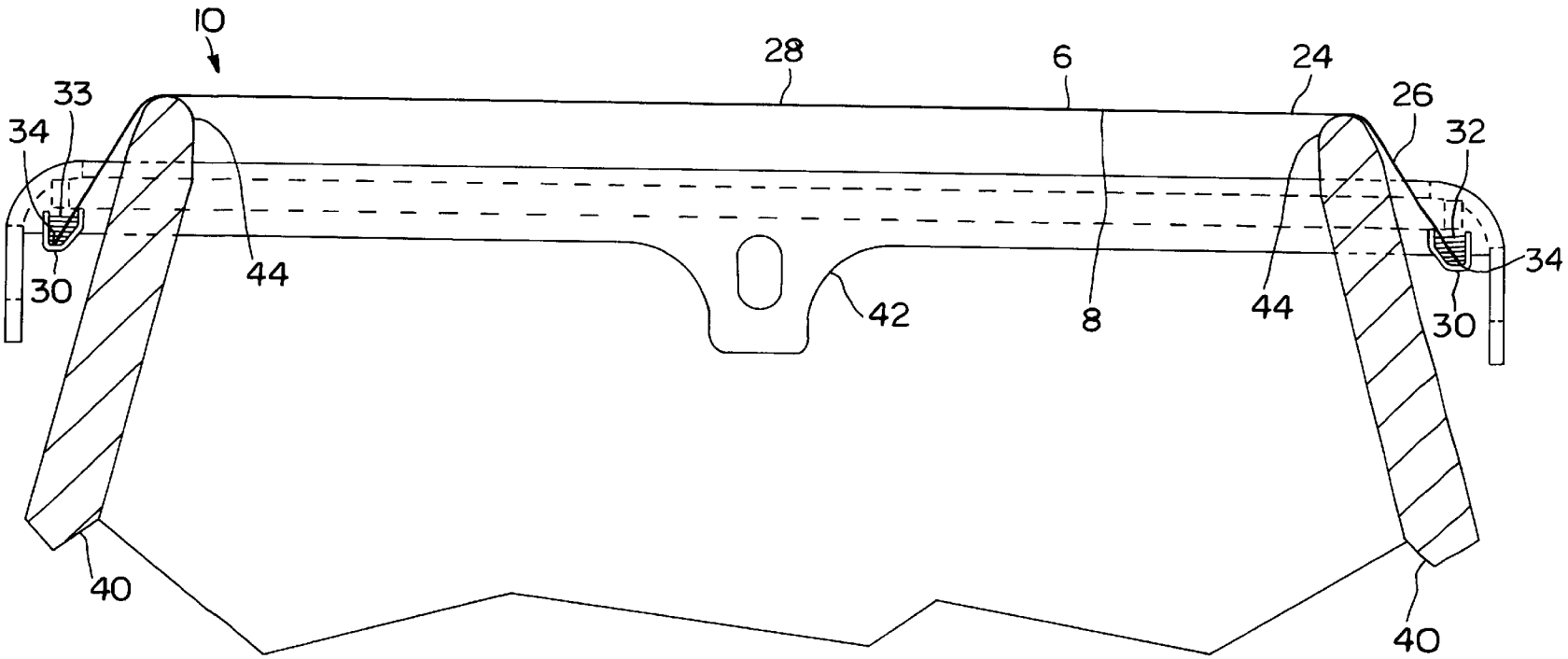
FIG. 5 is a cross-sectional view, partly in phantom, of a drum shell (partially illustrated), a drumhead consisting of a drumhead sheet and drum hoop and a counter-hoop in an installed configuration.

FIG. 5 illustrates a hand drumhead 10 constructed in accordance with the present invention installed over a drum shell 40 (partially illustrated). A counter hoop 42 engages the drum hoop 30 and pulls the drum hoop 30 toward the opposite end of the drum shell (not illustrated) creating tension in the planar central portion 28 of the drum head sheet 24. The conical connecting surface 26 connects the planar central portion 28 of the drumhead sheet 24 with the circular edge 34 which is secured in the annular interior space 32 of the drumhead 30.

Figure 6:
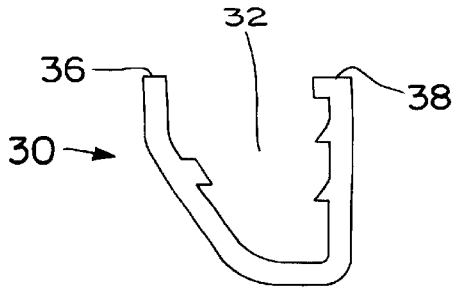
FIG. 6 is a schematic cross-sectional view of a drum hoop according to the present invention.
Figure 7:
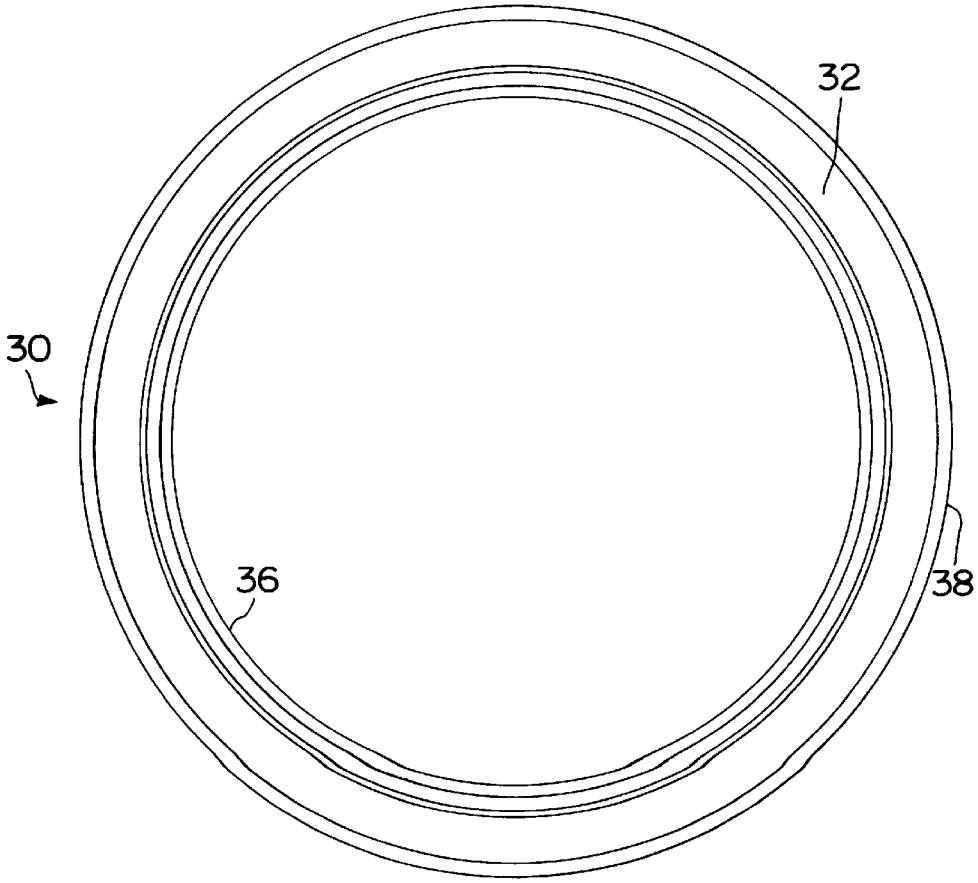
FIG. 7 is a top plan view of the drum hoop of FIG. 6.

FIGS. 6 and 7 illustrate the configuration of a drum hoop 30 appropriate for use in conjunction with the present invention. The drum hoop 30 is constructed of an extruded rigid material, preferably aluminum. FIG. 6 illustrates the generally U-shaped cross-section of the drum hoop 30 defining an interior space 32. FIG. 7 illustrates the drum hoop of FIG. 6 as seen from above. Upper inner edge 36 and upper outer edge 38 define an opening to the annular interior space 32.

Figure 8:
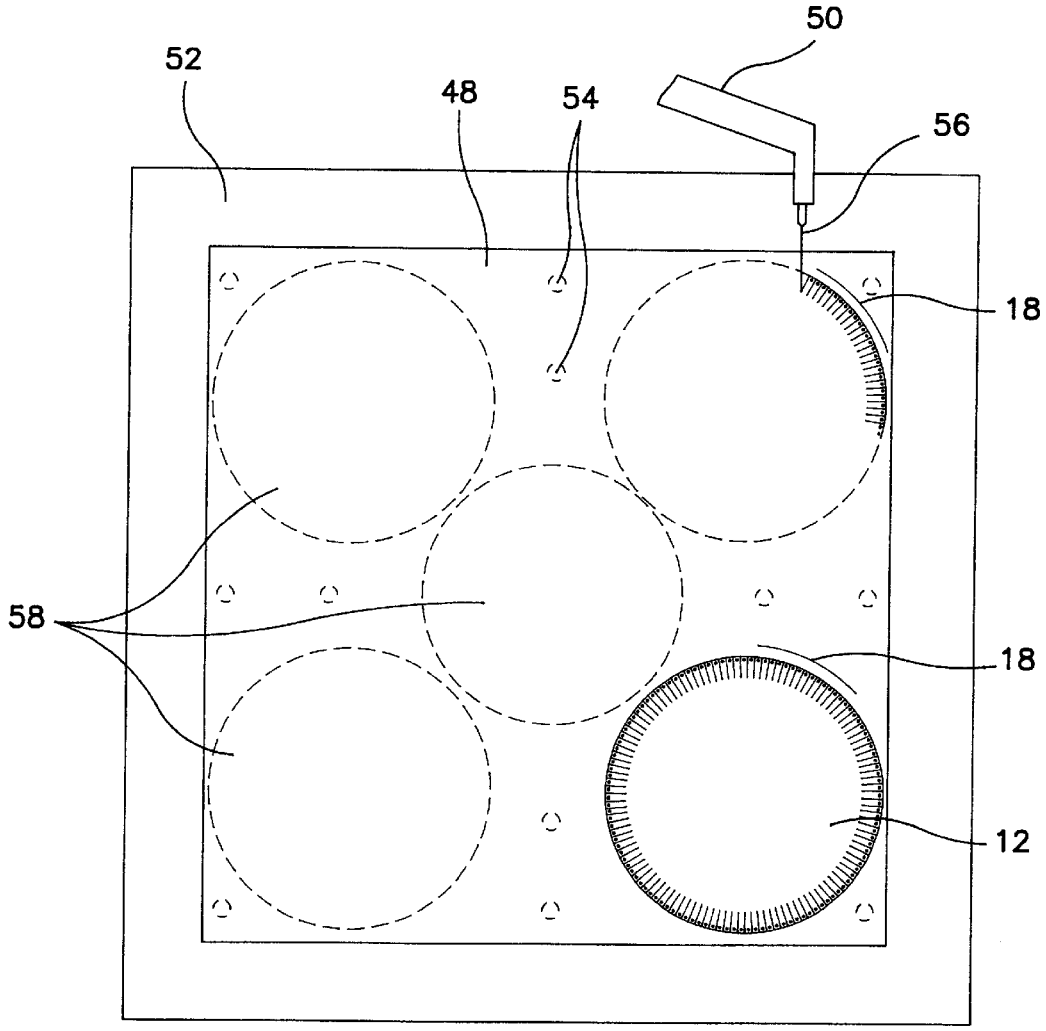
FIG. 8 is a plan view of several discs of FIG. 1 being produced according to the method of the claimed invention.

With reference to FIGS. 5 and 8, according to a preferred method, a sheet of material 48 which will form each layer of a drumhead sheet is selected according to its thickness, musical properties and other characteristics. Preferred materials for use in conjunction with the method of the present invention are polyester sheet materials having a thickness in the range of 0.015 to 0.025 inches. The layer discs used to form the drumhead may be cut from film having the same thickness or different thicknesses. Different combinations of layer thicknesses will produce drumheads having different musical characteristics.

The dimensions of the drumhead to be constructed are determined and used to calculate the diameter of a disc of layer material which will be necessary to produce a finished drumhead of that size. The diameter of the bearing area 44 of the drum shell 40 determines the diameter of the planar central portion 28 of the finished drumhead 10. A drum hoop 30 must be selected which will pass over the open end of the drum shell 40 far enough to create tension in the planar central portion 28 of the drumhead sheet 24. The diameter of the drum hoop selected determines the diameter of the circular edge 34 of the finished drumhead.

With these measurements, the amount of material to be removed from the peripheral edge portion 18 of each layer disc 12 in the form of V-shaped notches 16 may be determined. The amount of material to be removed varies dependent on the difference between the diameter of the unformed layer disc 12 and the diameter of the circular edge 34 of the formed head. The greater the difference between these two dimensions, the more material must be removed to create a smooth conical connecting surface 26. In a typical drumhead, approximately 30% of the material in the peripheral portion of the layer disc 12 is removed.

Once the dimensions and layout of the layer disc 12 have been determined, a machine tool (not illustrated) is preferably programmed to execute cutting the disc and its complex peripheral edge pattern from the selected sheet of drumhead material. The sheet of drumhead material 48 is placed on a vacuum table 52 and held in place by suction transmitted to the surface of the table through vacuum holes 54. The programmable tool is then programmed to cut the maximum possible number of layer discs 12 given the size and shape of the sheet 48. Locations for layer discs 12 are designated as target areas 58 on the sheet 48.

A $CO_2$ laser cutting head 50 using a 0.010 inch beam 56 set at 100 watts of power is preferably used in conjunction with the programmable machine tool to produce a layer disc 12 of precise shape having a peripheral edge 18 in the correct configuration without rough edges or excess material. With reference to FIG. 1B, the programmable machine tool is directed to move the laser beam from point w laterally to point x, radially inwardly from point x to point y, radially outwardly from point y to point z and laterally to point $x_1$ repeatedly around the peripheral edge of the target area 58 until a layer disc 12 is produced.

An example of a programmable machine tool which may be used to cut the layer discs is the REBEL model manufactured by Vytek, Inc. of 2 Omega Way, Littleton, Mass. Such a machine tool is preferably equipped with a laser cutting device which produces a fine beam in the range of 0.005 to 0.010 inches in diameter. The fine beam reduces heat buildup during cutting which can lead to burning of the layer material.

In a preferred embodiment, two such layer discs are cut for each finished drumhead. The layer discs are then placed one on top of the other, in an offset configuration, so that the V-shaped notches 16 of one layer are above or beneath the finger-like projections 16 of the other layer. In this fashion no notch 16 passes completely through to the interior surface 8 of the drumhead sheet 24 and nowhere is there extra material folded, overlapping or otherwise gathered. The layer discs so positioned are then bonded using heat and pressure in a mold (not illustrated) having a substantially planar central surface and a conical peripheral surface. The hot, bonded layer discs are then placed in a second, chilled mold of the same configuration. The chilled mold "sets" the bonded layer discs into the desired shape for the finished drumhead.

Once set, the two layers remain in the shape of the finished drumhead having a planar central surface 28 and a conical connecting surface 26 substantially formed from the alternating V-shaped notches and finger-like projections bonded in staggered fashion one over the other. The resulting formed drumhead sheet 24 terminates in a circular edge 34 which may be inserted into the annular interior space 32 defined by the drum hoop 30 and secured within that space by a resin 33.

In a preferred embodiment, each layer disc finger-like projection 14 has a single hole 20 formed near peripheral edge 18 by the laser cutting tool. The holes 20 allow the epoxy or resin to more securely engage the circular edge 34 of the drumhead sheet 24.

In another preferred embodiment, the drumhead 10 is rotated beneath several nozzles, (not illustrated) each propelling a high speed stream of very fine abrasive particles at the outwardly facing surface 6 of the drunhead 10. This process gives the normally smooth synthetic material a uniformly texturized surface having the friction and feel so important in drums which are played by the hand.

In an alternative embodiment, an acoustical damping element 22 may be inserted between the layer discs 12 of the drumhead 10. The damping element 22 alters the vibration characteristics of the finished drumhead to more closely duplicate the tonal qualities of a natural skin drumhead.

Other modifications and alternative embodiments of the invention will be apparent to those skilled in the art in view of the foregoing description. This description is to be construed as illustrative only and is for the purpose of teaching those skilled in the art the best mode of carrying out the invention. The details of the structure and method may be varied substantially without departing from the spirit of the invention and the exclusive use of all modifications which come within the scope of the appended claims is reserved.

What is claimed is:

1. A method of forming a hand drumhead layer disc comprising:

positioning a sheet of filmic material at a work station;

locating a numerically controlled machine arm with laser cutting tool over a target position on the sheet;

activating said laser cutting tool and controlling said arm to move continuously from said target position to produce a series of substantially lateral, substantially radially inward, substantially radially outward, and substantially lateral cuts, thereby forming a disc of filmic material having a peripheral edge portion composed of alternating equal size V-shaped notches and finger-like projections.

2. The method of claim 1, wherein said method comprises cutting a hole in the center of each said projection near the peripheral edge of said disc.

3. The method of claim 1, wherein said method comprises cutting multiple layer discs from said sheet of filmic material.

4. The method of claim 1, wherein said method comprises positioning multiple sheets of filmic material at a work station and cutting through said sheets to form multiple layer discs at the same time.

5. The method of claim 1, wherein said laser cutting tool generates a laser beam having a width in the range of 0.005–0.010 inch and said beam has a power in the range of 100 watts.

6. A method of cutting a drumhead sheet comprising:

a. selecting a piece of filmic material;

b. selecting the dimensions desired for a finished drumhead;

c. calculating the diameter a disc of said filmic material must have to form the drumhead having the finished dimensions selected in step b;

d. calculating the size and shape of material to be removed from a peripheral edge portion of said disc which will allow the material to take the shape required to form the drumhead selected in step b;

e. programming a numerically controlled machine having a laser cutting tool to cut said disc having the diameter calculated in step c and remove material in the size and shape calculated in step d from the peripheral edge portion of said disc; and g. directing said laser tool to cut said disc from said piece of filmic material.

7. The method of claim 6, wherein said filmic material comprises a polyester film having a thickness in the range of 0.015–0.025 inch.

8. The method of claim 6, wherein said laser cutting tool generates a laser beam having a width in the range of 0.005–0.010 inch and a power output of approximately 100 watts.

9. A synthetic hand drum head comprising:

a drumhead sheet having a substantially planar central portion surrounded by a substantially conical connecting surface and terminating in a circular edge axially displaced from said planar central portion, said sheet including first and second layer discs having peripheral edges, said peripheral edges cut into a series of equal size V-shaped notches alternating with finger like projections, said first disc bonded on top of said second disc with said peripheral edges substantially aligned and said first disc projections covering said second disc notches and said second disc projections beneath said first disc notches, the bonded peripheral edge portions of said discs substantially forming said conical connecting surface, and a rigid drum hoop including an annular ring having a generally U-shaped cross section defining an annular space, with said circular edge secured within said annular space.

10. The drumhead of claim 9, wherein said discs are bonded by heat and pressure.

11. The drumhead of claim 9, wherein said first disc has a thickness in the range of 0.015–0.025 inch and said second disc has a thickness in the range of 0.015–0.025 inch.

12. The drumhead of claim 9, wherein said circular edge is secured in said annular space by a resin.

13. A method for manufacturing a synthetic hand drum head which comprises:

a. selecting first and second sheets of drumhead material;

b. directing a laser to cut a first disc with alternating V-shaped notches and finger like projections of equal size forming the peripheral edge of the disc from said first sheet;

c. directing said laser to cut a second disc with alternating V-shaped notches and finger like projections of equal size forming the peripheral edge of the disc from said second sheet;

d. positioning said first disc on top of said second disc with said peripheral edges substantially aligned and said first disc projections covering said second disc notches and said second disc projections beneath said first disc notches;

e. bonding said first and second discs to form a drumhead sheet having outer and inner surfaces, and a substantially planar central portion surrounded by a substantially conical connecting surface, the bonded peripheral edge portions of said discs substantially forming said conical connecting surface, said drumhead sheet terminating in a circular edge axially spaced from said planar central portion;

f. selecting a drum hoop including a rigid, generally U-shaped cross section defining an annular space, said annular space having a diameter sized to receive said circular edge; and g. securing said drumhead sheet circular edge within said drum hoop annular space.

14. The method of claim 13, wherein said bonding comprises using heat and pressure to bond said discs in a mold having a substantially planar central portion surrounded by a substantially conical peripheral surface.

15. The method of claim 14, wherein said bonding further comprises removing the hot drumhead sheet from said mold and placing said hot drumhead sheet in a second, chilled mold where said drumhead sheet is further exposed to pressure.

16. The method of claim 13, wherein steps b and c include directing said laser to cut a hole in each said finger like projection near said peripheral edge.

17. The method of claim 13, wherein said method comprises the step of etching a texture on the outer surface of the drumhead sheet.

18. The method of claim 13, wherein said method comprises the steps of selecting a damping element and positioning said damping element between said discs substantially in the center of said discs.

19. The method of claim 13, wherein said drumhead material comprise sheets of polyester having a thickness in the range of 0.015–0.025 inch.

20. The method of claim 13, wherein said laser generates a beam having a width in the range of 0.005–0.010 inch and a power output of approximately 100 watts.

* * * * *